US005690251A

United States Patent [19]

Wade

[11] Patent Number: 5,690,251

[45] Date of Patent: Nov. 25, 1997

[54] PANTY HOSE VENDING MACHINE

[76] Inventor: Diane K. Wade, 12 Summit St. #102, East Orange, N.J. 07017

[21] Appl. No.: 630,943

[22] Filed: Apr. 5, 1996

[51] Int. Cl.[6] ..... G07F 11/00

[52] U.S. Cl. ..... 221/76; 221/277

[58] Field of Search ..... 221/76, 77, 78, 221/131, 123, 119, 277; 312/97

[56] References Cited

U.S. PATENT DOCUMENTS 5,509,573 4/1996 Campoli ..... 221/277
5,533,645 7/1996 Wittern, Jr. et al. ..... 221/76

*Primary Examiner*—Kenneth Noland

[57] ABSTRACT

A panty hose vending machine including a housing with a plurality of dispensers situated therein. A label with indicia indicative of both a panty hose size and a panty hose color imprinted thereon is situated on each dispenser. A plurality of panty hose are situated within each dispenser with a corresponding label, wherein the panty hose are adapted to be made accessible to a user upon the actuation of the dispenser. Each panty hose comprises a thin square envelope with a transparent front face for viewing the panty hose therein. Also included is a money exchanger adapted to accept and account for money and further dispense change. Finally, a selection panel is situated on the housing including first row buttons each having indicia indicative of one of a plurality of sizes of panty hose and second row buttons each having indicia indicative of one of a plurality of colors of panty hose. The selection panel is adapted to actuate a dispenser upon the acceptance and accounting for a proper amount of money and subsequent depression of a first row button and a second row button both of which correspond to the label of the dispenser.

4 Claims, 3 Drawing Sheets

PANTY HOSE VENDING MACHINE

BACKGROUND OF THE INVENTION

1. Field of the Invention

The present invention relates to a panty hose vending machine and more particularly pertains to allowing the convenient purchase of panty hose.

2. Description of the Prior Art

The use of vending machines is known in the prior art. More specifically, vending machines heretofore devised and utilized for the purpose of selling items are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,547,313 to Pitel a machine for sequentially dispensing articles from a vending unit comprising a series of horizontal article supporting shelves. U.S. Pat. No. 3,287,074 to Crossley discloses a coin fed vending machine in which articles to be dispensed are disposed on a series of shelves which are brought successively into register with a delivery aperture. U.S. Pat. Des. 328,924 to Hamilton discloses the ornamental design for a panty hose vending machine. U.S. Pat. No. 309,634 to McDaniel et al.; U.S. Pat. No. 4,669,596 to Capers et al.; and U.S. Pat. Des. 344,761 to Muehlberger are disclosed as being of general interest.

In this respect, the panty hose vending machine according to the present invention substantially departs from the conventional concepts and designs of the prior art, and in so doing provides an apparatus primarily developed for the purpose of allowing the convenient purchase of panty hose.

Therefore, it can be appreciated that there exists a continuing need for a new and improved panty hose vending machine which can be used for allowing the convenient purchase of panty hose. In this regard, the present invention substantially fulfills this need.

SUMMARY OF THE INVENTION

In view of the foregoing disadvantages inherent in the known types of vending machines now present in the prior art, the present invention provides an improved panty hose vending machine. As such, the general purpose of the present invention, which will be described subsequently in greater detail, is to provide a new and improved panty hose vending machine which has all the advantages of the prior art and none of the disadvantages.

To attain this, the present invention essentially comprises a compact housing with a generally rectangular configuration with a front panel, a rear face, a top surface, a bottom surface, and a pair of side edges formed therebetween defining an interior space. The front panel is hingably coupled to the housing with a lock having a first open orientation for allowing access within the interior space and a second orientation for precluding such access. The front panel further comprises a transparent plastic plate positioned at an upper extent thereof and a control panel situated at a lower extent thereof. A plurality of mounts are formed on the rear panel for mounting the housing to a wall. As best shown in FIG. 5 & 6, a plurality of elongated trays are coupled within the interior space to the rear face and extended horizontally therefrom. The trays are visible through the transparent front panel. The trays each include an elongated slit longitudinally formed therein. A helix resides lengthwise within each slit with a motor coupled to an inboard end thereof. The motor is adapted to rotate the helix one complete revolution upon the actuation thereof. With reference now to FIG. 4, a plurality of labels with indicia indicative of both a panty hose size and a panty hose color imprinted thereon and are situated on an outboard end of each tray. Also included are a plurality of panty hose situated within each spiral of the helixes with a corresponding label. Upon actuation of the motor, the panty hose are adapted to drop from the outboard end of each tray into a dispensing pan accessible to a user. Each panty hose comprises a thin square envelope with a transparent front face for viewing the panty hose therein. A money exchanger, shown in FIG. 3, is situated on the control panel of the front panel at a right extent thereof. The money exchanger is adapted to accept and account for money in the form of bills and coins. The money exchanger is further adapted to dispense change in the form of coins. Finally, a selection panel is situated on the control panel of the front panel at a left extent thereof. The selection panel includes first row buttons each having indicia indicative of one of a plurality of sizes of panty hose and second row buttons each having indicia indicative of one of a plurality of colors of panty hose. The selection panel is adapted to actuate the motor of a tray upon the acceptance and accounting for a proper amount of money. To facilitate selection, the user may depress a first row button and a second row button both of which correspond to the label of the tray containing a pair of desired panty hose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved panty hose vending machine which has all the advantages of the prior art vending machines and none of the disadvantages.

It is another object of the present invention to provide a new and improved panty hose vending machine which may be easily and efficiently manufactured and marketed.

It is a further object of the present invention to provide a new and improved panty hose vending machine which is of a durable and reliable construction.

An even further object of the present invention is to provide a new and improved panty hose vending machine which is susceptible of a low cost of manufacture with regard to both materials and labor, and which accordingly is then susceptible of low prices of sale to the consuming public, thereby making such panty hose vending machine economically available to the buying public.

Still yet another object of the present invention is to provide a new and improved panty hose vending machine which provides in the apparatuses and methods of the prior art some of the advantages thereof, while simultaneously overcoming some of the disadvantages normally associated therewith.

Still another object of the present invention is to allow the convenient purchase of panty hose.

Lastly, it is an object of the present invention to provide a new and improved panty hose vending machine including a housing with a plurality of dispensers situated therein. A label with indicia indicative of both a panty hose size and a panty hose color imprinted thereon is situated on each dispenser. A plurality of panty hose are situated within each dispenser with a corresponding label, wherein the panty hose are adapted to be made accessible to a user upon the actuation of the dispenser. Each panty hose comprises a thin square envelope with a transparent front face for viewing the panty hose therein. Also included is a money exchanger adapted to accept and account for money and further dispense change. Finally, a selection panel is situated on the housing including first row buttons each having indicia indicative of one of a plurality of sizes of panty hose and second row buttons each having indicia indicative of one of a plurality of colors of panty hose. The selection panel is adapted to actuate a dispenser upon the acceptance and accounting for a proper amount of money and subsequent depression of a first row button and a second row button both of which correspond to the label of the dispenser.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
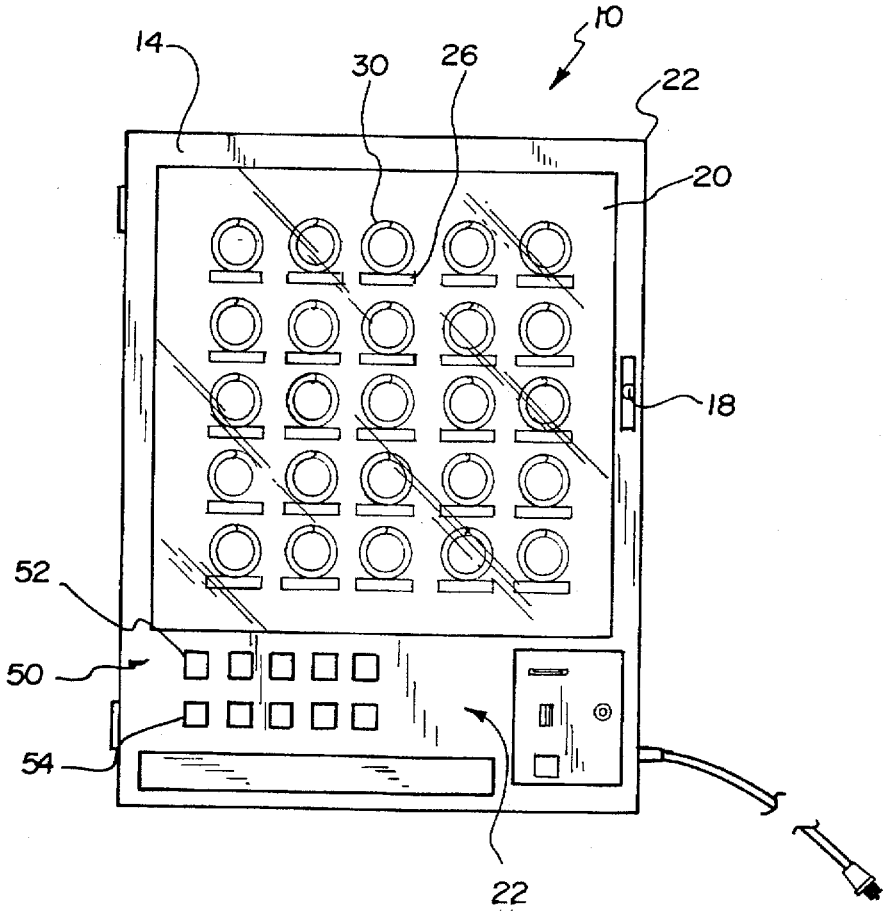
FIG. 1 is a plan illustration of the preferred embodiment of the panty hose vending machine constructed in accordance with the principles of the present invention.
Figure 2:
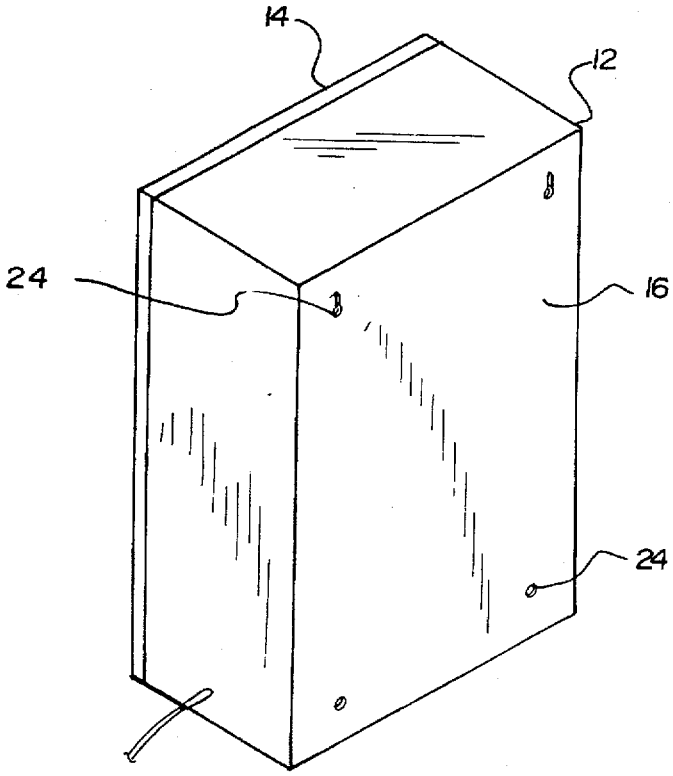
FIG. 2 is a perspective view of the rear face of the present invention.

With reference now to the drawings, and in particular to FIG. 1 thereof, a new and improved panty hose vending machine embodying the principles and concepts of the present invention and generally designated by the reference numeral 10 will be described.

The present invention, the new and improved panty hose vending machine, is comprised of a plurality of components. Such components in their broadest context include a housing, trays, panty hose, labels, money exchanger, and selection panel. Such components are individually configured and correlated with respect to each other so as to attain the desired objective.

More specifically, it will be noted that the system 10 of the present invention includes a compact housing 12 with a generally rectangular configuration with a front panel 14, a rear face 16, a top surface, a bottom surface, and a pair of side edges formed therebetween defining an interior space. Ideally, the housing has a height of approximately 30 inches, a length of approximately 30 inches, and a width of approximately 20 inches. The front panel 14 is hingably coupled to the housing with a lock 18 having a first open orientation for allowing access within the interior space and a second orientation for precluding such access. The front panel further comprises a transparent plastic plate 20 positioned at an upper extent thereof and a control panel 22 situated at a lower extent thereof. Such a transparent plastic plate is made of a heavy duty material and is adapted to withstand substantial impact. A plurality of mounts 24 are formed on the rear panel for mounting the housing to a wall. The mounts may consist of a plurality of bores formed in each of the four corners of the rear face.

Figure 5:
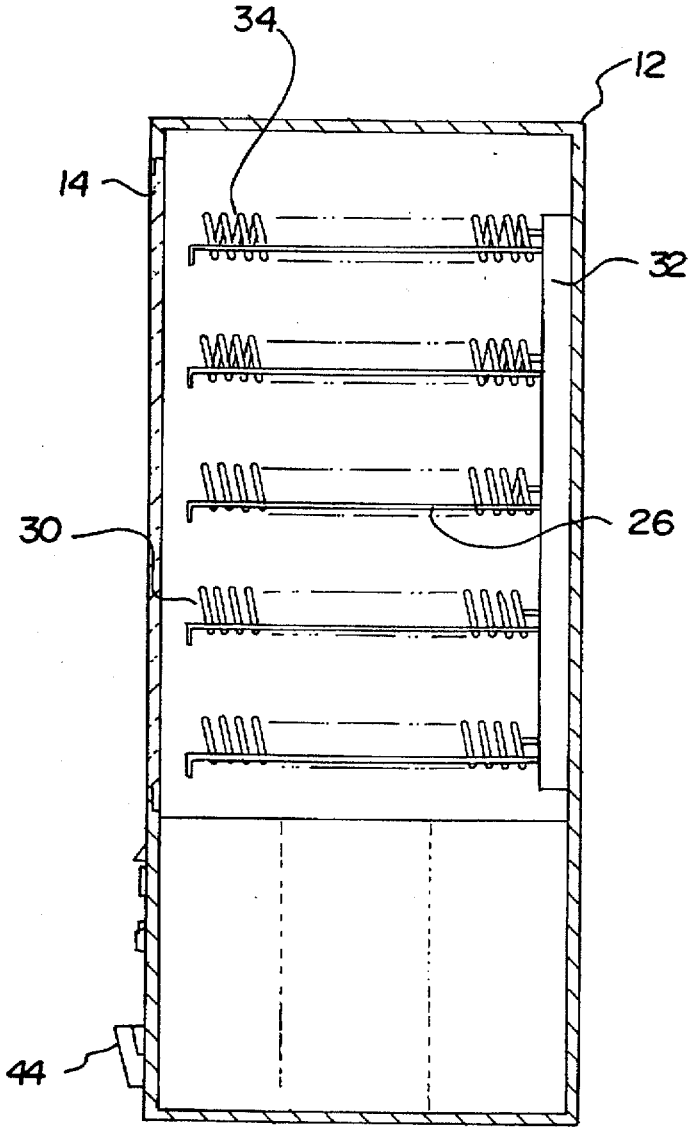
FIG. 5 is a cross-sectional view of the present invention.
Figure 6:
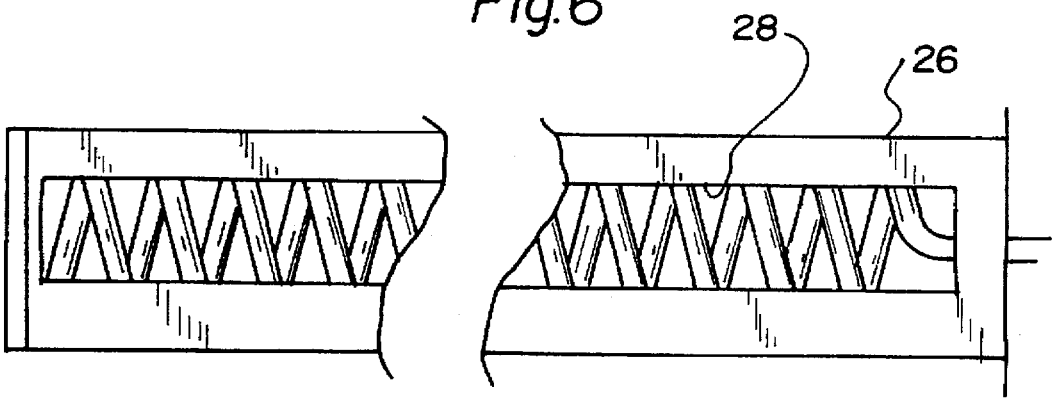
FIG. 6 is a close-up bottom view of the tray and associated helix of the present invention.

As best shown in FIG. 5 & 6, a plurality of elongated trays 26 are coupled within the interior space to the rear face and extended horizontally therefrom. The trays are visible through the transparent front panel. The trays each include an elongated slit 28 longitudinally formed therein. A helix 30 resides lengthwise within each slit with a motor 32 coupled to an inboard end thereof. The helix preferably comprises of 5–8 concentric spirals 34 which are thinly spaced. The motor is adapted to rotate the helix one complete revolution upon the actuation thereof.

Figure 4:
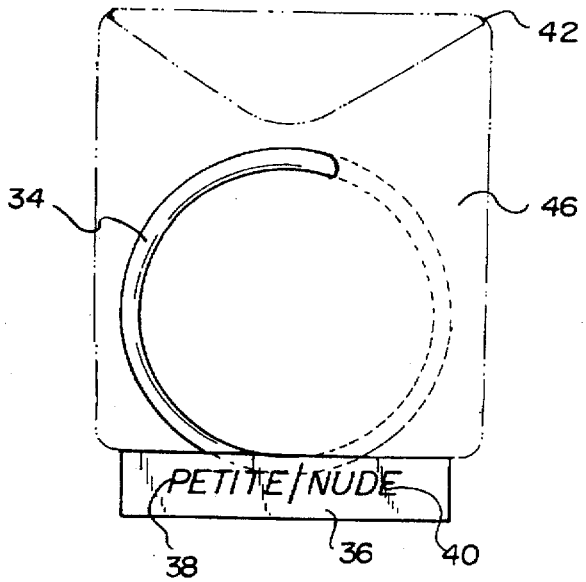
FIG. 4 is a front elevational view of the tray and panty hose of the present invention.

With reference now to FIG. 4, a plurality of labels 36 with indicia indicative of both a panty hose size 38 and a panty hose color 40 imprinted thereon and are situated on an outboard end of each tray.

Also included are a plurality of panty hose 42 situated within each spiral of the helixes with a corresponding label. Upon actuation of the motor, the panty hose are adapted to drop from the outboard end of each tray into a dispensing pan 44 accessible to a user. Such dispensing pan is adapted to allow access to a user solely when a panty hose is purchased in order to avoid theft and vandalism. Each panty hose comprises a thin square envelope 46 with a transparent front face for viewing the panty hose therein. Additionally, the envelope may be constructed with a tab depending from a lower edge thereof for releasably inserting within the slit of the trays. Ideally, the envelope is constructed of a rigid material such as cardboard.

Figure 3:
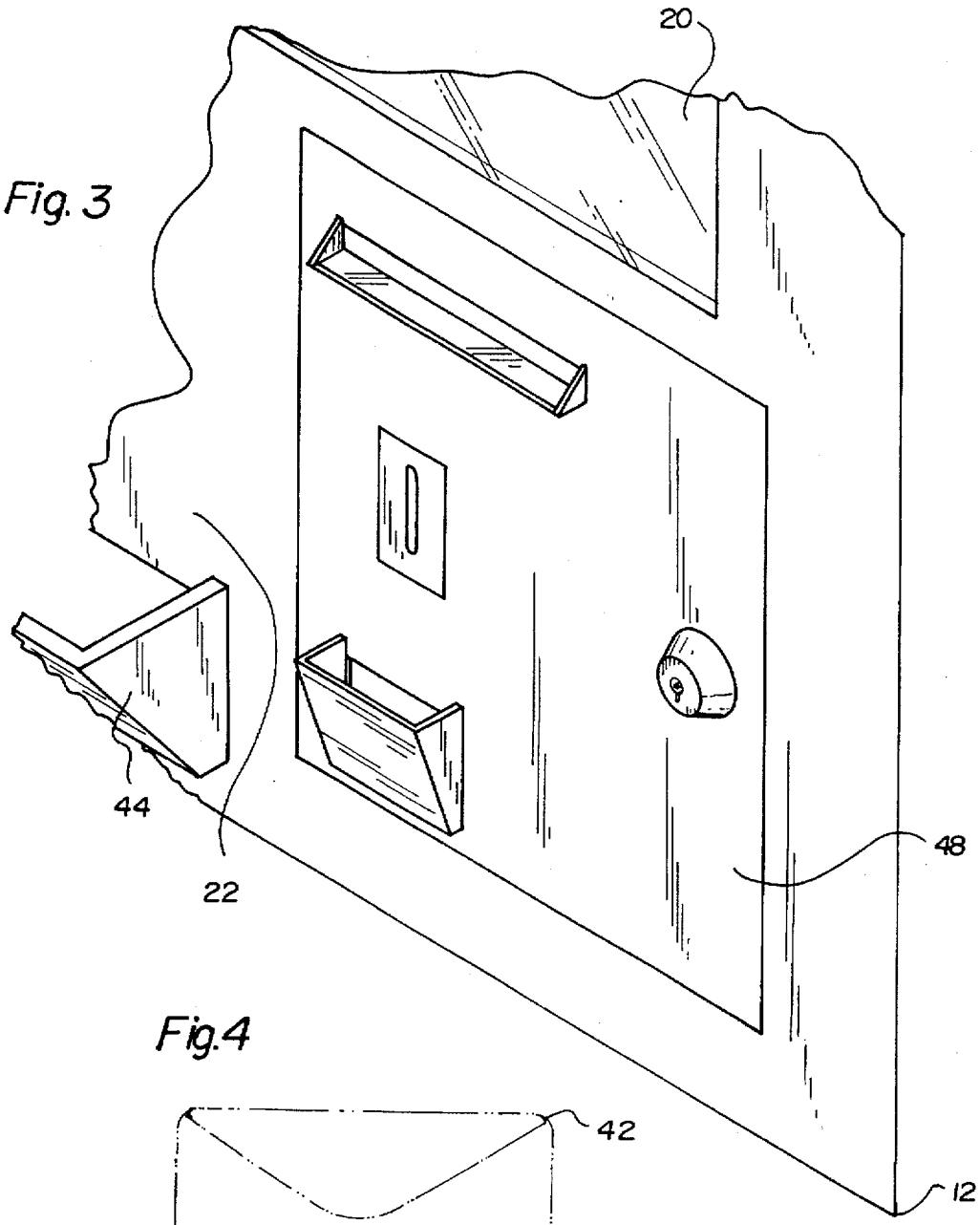
FIG. 3 is a cut-away view of the money exchanger of the present invention.

A money exchanger 48, shown in FIG. 3, is situated on the control panel of the front panel at a right extent thereof. The money exchanger is adapted to accept and account for money in the form of bills and coins. A plurality of money bins, shown in FIG. 5, are included so as to allow the machine to go without service for long periods of time. The money exchanger is further adapted to dispense change in the form of coins.

Finally, a selection panel 50 is situated on the control panel of the front panel at a left extent thereof. The selection panel includes first row of buttons 52 linearly alighted in a horizontal orientation with each having indicia indicative of one of a plurality of sizes of panty hose. Such first row buttons include a petite button, a small button, a medium button, a large button, a large button, and an extra large button. A second row of buttons 54 are linearly aligned below the first set with each button having indicia indicative of one of a plurality of colors of panty hose. The second row buttons preferably include a black button, a blue button, a coffee button, a nude button, and a white button. Additionally, the second row buttons may be color coordinated with the corresponding panty hose thereof. The selection panel is adapted to actuate the motor of a tray upon the acceptance and accounting for a proper amount of money. To facilitate selection, the user may depress a first row button and a second row button both of which correspond to the label of the tray containing a pair of desired panty hose.

The present invention allows a user to avoid the uneasy predicament of having a run or snag in her panty hose. It may be installed in a mall, cafeteria, rest stop, and company facility. To deter vandalism especially common in restrooms, the panty hose vending machine employs a specially adapted dispensing pan and a heavy duty transparent front panel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved panty hose vending machine comprising, in combination:

a compact housing with a generally rectangular configuration with a front panel, a rear face, a top surface, a bottom surface, and a pair of side edges formed therebetween defining an interior space, the front panel hingably coupled to the housing with a lock having a first open orientation for allowing access within the interior space and a second orientation for precluding said access, the front panel further comprising a transparent plastic plate positioned at an upper extent thereof and a control panel situated at a lower extent thereof, wherein a plurality of mounting means are formed on the rear panel for mounting the housing to a wall;

a plurality of elongated trays coupled within the interior space on the rear face and extended horizontally therefrom, wherein the trays are visible through the transparent front panel, the trays each including an elongated slit longitudinally formed therein, a helix residing lengthwise within each slit, and a motor coupled to an inboard end of each helix and adapted to rotate the helix one complete revolution upon the actuation thereof;

a plurality of labels with indicia indicative of both a panty hose size and a panty hose color situated on an outboard end of each tray;

a plurality of panty hose situated within each of the helixes of a tray with a corresponding label, wherein the panty hose are adapted to drop from the outboard end of each tray into a dispensing pan accessible to a user upon actuation of the motor, the panty hose comprising a thin square envelope with a transparent front face for viewing the panty hose therein;

a money exchanger situated on the control panel of the front panel at a right extent thereof, the money exchanger adapted to accept and account for money in the form of bills and coins and further dispense change in the form of coins; and a selection panel situated on the control panel of the front panel at a left extent thereof, the selection panel including first row buttons each having indicia indicative of one of a plurality of sizes of panty hose and second row buttons each having indicia indicative of one of a plurality of colors of panty hose, the selection panel adapted to actuate the motor of a tray upon the acceptance and accounting for a proper amount of money and subsequent depression of a first row button and a second row button which correspond to the label of the tray.

2. A panty hose vending machine comprising:

a housing;

a plurality of dispensing means situated within the housing;

a plurality of labels with indicia indicative of both a panty hose size and a panty hose color situated on each dispensing means;

a plurality of panty hose situated within each dispensing means with a corresponding label, wherein the panty hose are adapted to be made accessible to a user upon the actuation of the dispensing means, the panty hose comprising a thin square envelope with a transparent front face for viewing the panty hose therein;

a money exchanging means adapted to accept and account for money and further dispense change; and a selection panel situated on the housing including first row buttons each having indicia indicative of one of a plurality of sizes of panty hose and second row buttons each having indicia indicative of one of a plurality of colors of panty hose, the selection panel adapted to actuate a dispensing means upon the acceptance and accounting for a proper amount of money and subsequent depression of a first row button and a second row button both of which correspond to the label of the dispensing means.

3. A panty hose vending machine as set forth in claim 2 wherein the housing comprises a front panel, a rear face, a top surface, a bottom surface, and a pair of side edges formed therebetween defining an interior space, the front panel hingably coupled to the housing with a lock having a first open orientation for allowing access within the interior space and a second orientation for precluding said access, the front panel further comprising a transparent plastic plate positioned at an upper extent thereof and a control panel situated at a lower extent thereof, wherein a plurality of mounting means are formed on the rear panel for mounting the housing to a wall.

4. A panty hose vending machine as set forth in claim 2 wherein the dispensing means comprises a plurality of elongated trays coupled within the housing to a rear face thereof and extended horizontally therefrom, wherein the trays are visible to a user, the trays each including an elongated slit longitudinally formed therein, a helix residing lengthwise within each slit, and a motor coupled to an inboard end of each helix and adapted to rotate the helix one complete revolution upon the actuation thereof.

* * * * *